US006269922B1

(12) United States Patent
Gosse

(10) Patent No.: US 6,269,922 B1
(45) Date of Patent: Aug. 7, 2001

(54) BAG ASSEMBLY

(76) Inventor: Robert E. Gosse, 50 Alison Avenue, Cambridge, Ontario (CA), N1R 1N1

( * ) Notice: Subject to any disclaimer, the term of this patent is extended or adjusted under 35 U.S.C. 154(b) by 0 days.

(21) Appl. No.: 09/616,920

(22) Filed: Jul. 14, 2000

(51) Int. Cl.[7] ..... A45C 7/00; A45C 13/04

(52) U.S. Cl. ..... 190/107; 206/287.1; 190/113; 190/122

(58) Field of Search ..... 190/107, 122, 190/113; 206/287.1

(56) References Cited

U.S. PATENT DOCUMENTS

| | | | | |
|---|---|---|---|---|
| D. 363,600 | | 10/1995 | Medlen . | |
| 668,864 | | 2/1901 | Watson . | |
| 792,793 | | 6/1905 | Richmond . | |
| 930,343 | | 8/1909 | Bonsall . | |
| 1,294,753 | * | 2/1919 | Banister | 190/122 X |
| 1,804,122 | * | 5/1931 | Singer | 190/122 |
| 2,016,520 | * | 10/1935 | Short | 190/122 X |
| 2,318,527 | * | 5/1943 | Rosenthal | 190/122 X |
| 2,476,932 | | 7/1949 | Tucker . | |
| 2,798,579 | * | 7/1957 | Fox | 190/12 |
| 2,841,257 | * | 7/1958 | Dallas | 190/113 X |
| 4,880,089 | * | 11/1989 | Chombert et al. | 190/122 X |
| 4,982,820 | | 1/1991 | Scott . | |
| 5,906,277 | * | 5/1999 | Vienneau | 206/287.1 |

FOREIGN PATENT DOCUMENTS

| | | | | |
|---|---|---|---|---|
| 1062255 | * | 9/1959 | (FR) | 190/122 |
| 554391 | * | 9/1959 | (BE) | 190/113 |
| 2542989 | * | 9/1984 | (FR) | 190/122 |

* cited by examiner

*Primary Examiner*—Sue A. Weaver

(57) ABSTRACT

A bag assembly for saving time in the organization, storage, and transportation of sporting equipment. The bag assembly includes a frame assembly with a pivotable upper frame member, a cover member, and a pair of strap members.

18 Claims, 4 Drawing Sheets

BAG ASSEMBLY

BACKGROUND OF THE INVENTION

1. Field of the Invention

The present invention relates to convertible bags and more particularly pertains to a new bag assembly for saving time in the organization, storage, and transportation of sporting equipment.

2. Description of the Prior Art

The use of convertible bags is known in the prior art. More specifically, convertible bags heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 4,982,820; 2,476,932; 668,864; 930,343; 792,793; and U.S. Pat. No. Design 363,600.

While these devices fulfill their respective, particular objectives and requirements, the aforementioned patents do not disclose a new bag assembly. The inventive device includes a frame assembly with a pivotable upper frame member, a cover member, and a pair of strap members.

In these respects, the bag assembly according to the present invention substantially departs from the conventional concepts and designs of the prior art, and in so doing provides an apparatus primarily developed for the purpose of saving time in the organization, storage, and transportation of sporting equipment.

SUMMARY OF THE INVENTION

In view of the foregoing disadvantages inherent in the known types of convertible bags now present in the prior art, the present invention provides a new bag assembly construction wherein the same can be utilized for saving time in the organization, storage, and transportation of sporting equipment.

The general purpose of the present invention, which will be described subsequently in greater detail, is to provide a new bag assembly apparatus and method which has many of the advantages of the convertible bags mentioned heretofore and many novel features that result in a new bag assembly which is not anticipated, rendered obvious, suggested, or even implied by any of the prior art convertible bags, either alone or in any combination thereof.

To attain this, the present invention generally comprises a frame assembly with a pivotable upper frame member, a cover member, and a pair of strap members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bag assembly apparatus and method which has many of the advantages of the convertible bags mentioned heretofore and many novel features that result in a new bag assembly which is not anticipated, rendered obvious, suggested, or even implied by any of the prior art convertible bags, either alone or in any combination thereof.

It is another object of the present invention to provide a new bag assembly that may be easily and efficiently manufactured and marketed.

It is a further object of the present invention to provide a new bag assembly that is of a durable and reliable construction.

An even further object of the present invention is to provide a new bag assembly which is susceptible of a low cost of manufacture with regard to both materials and labor, and which accordingly is then susceptible of low prices of sale to the consuming public, thereby making such bag assembly economically available to the buying public.

Still yet another object of the present invention is to provide a new bag assembly which provides in the apparatuses and methods of the prior art some of the advantages thereof, while simultaneously overcoming some of the disadvantages normally associated therewith.

Still another object of the present invention is to provide a new bag assembly for saving time in the organization, storage, and transportation of sporting equipment.

Yet another object of the present invention is to provide a new bag assembly which includes a frame assembly, a cover member, and a pair of strap members.

Still yet another object of the present invention is to provide a new bag assembly that facilitates the air-drying of sporting equipment.

Even still another object of the present invention is to provide a new bag assembly that provides and organizational system for storing, putting on, and taking off sporting equipment.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
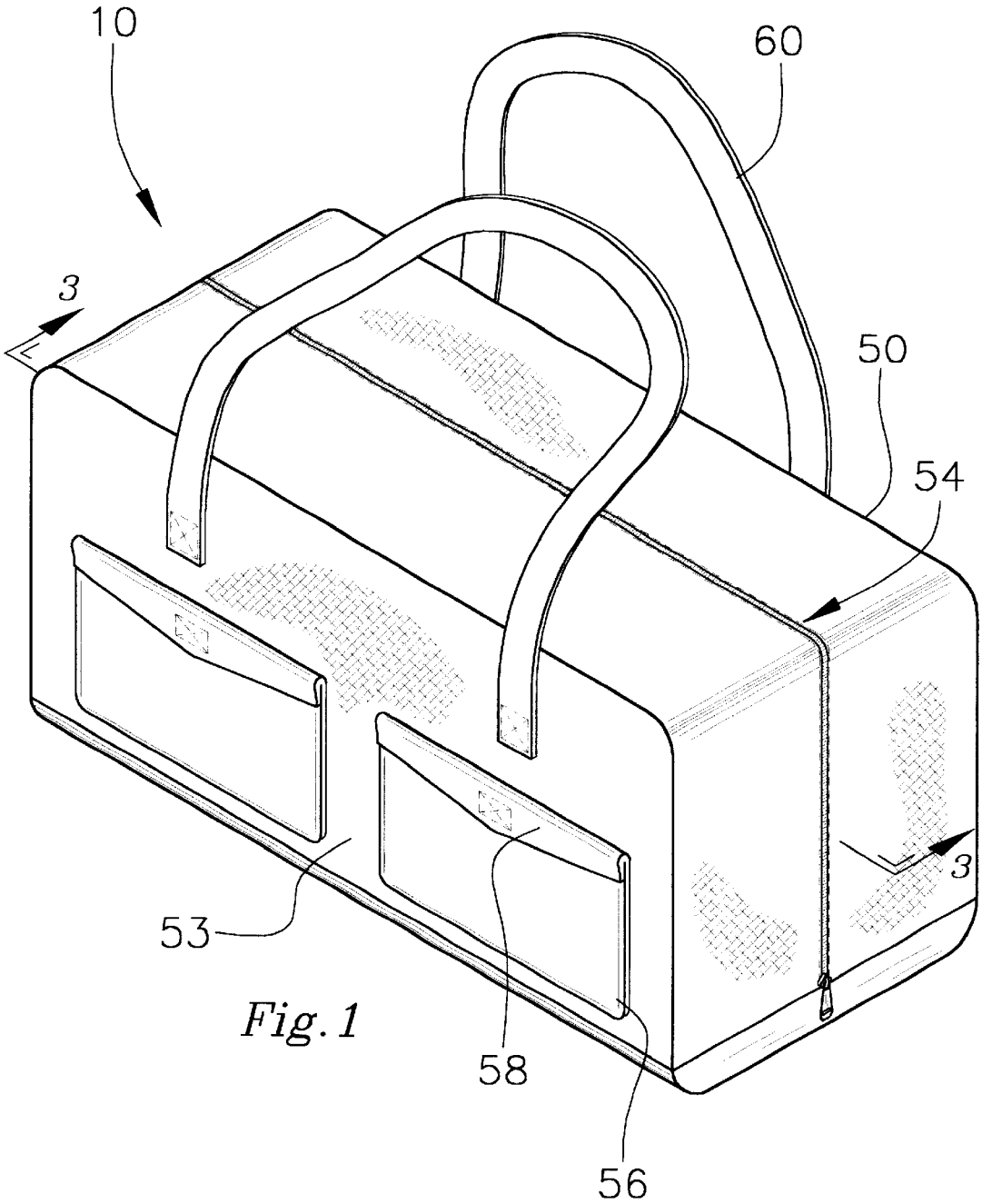
FIG. 1 is a schematic perspective view of a new bag assembly according to the present invention.
Figure 2:
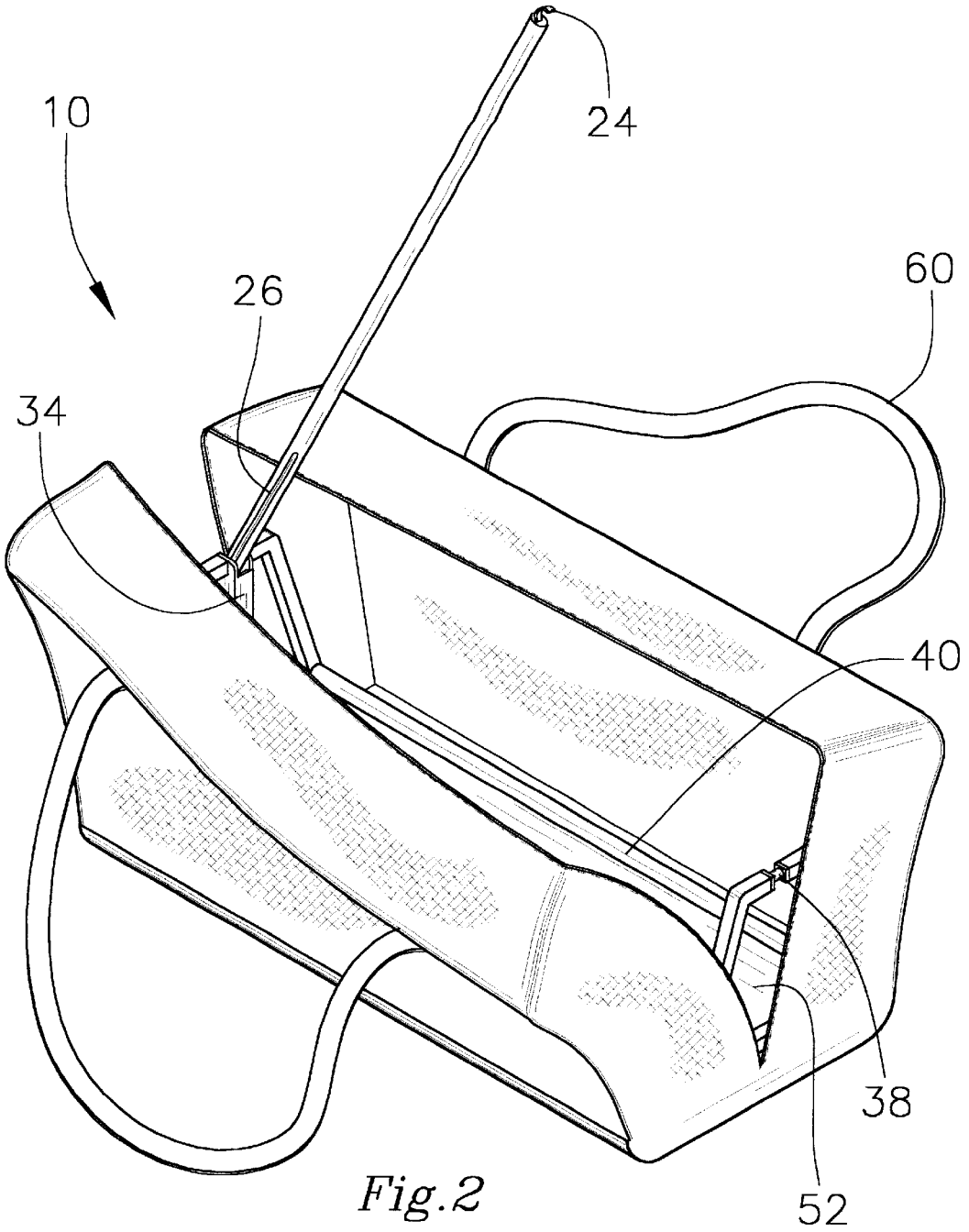
FIG. 2 is a schematic perspective view of the present invention in the open condition.
Figure 3:
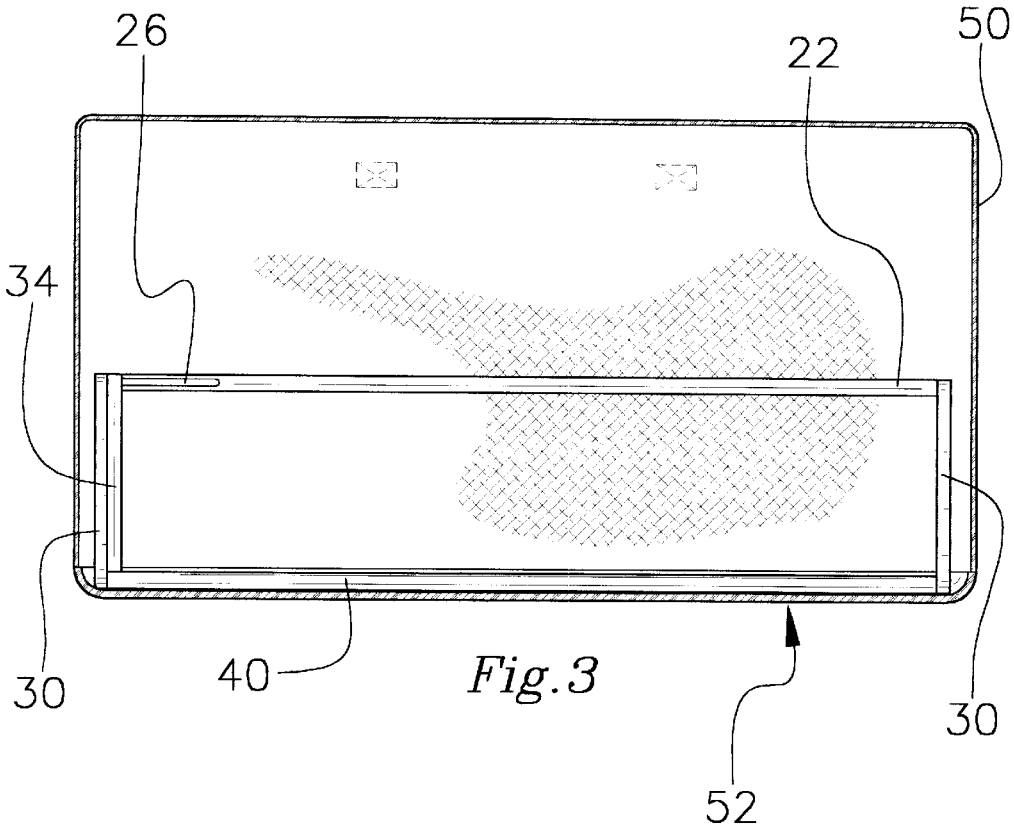
FIG. 3 is a schematic cross-sectional taken along line 3—3 of FIG. 1 view of the present invention.
Figure 4:
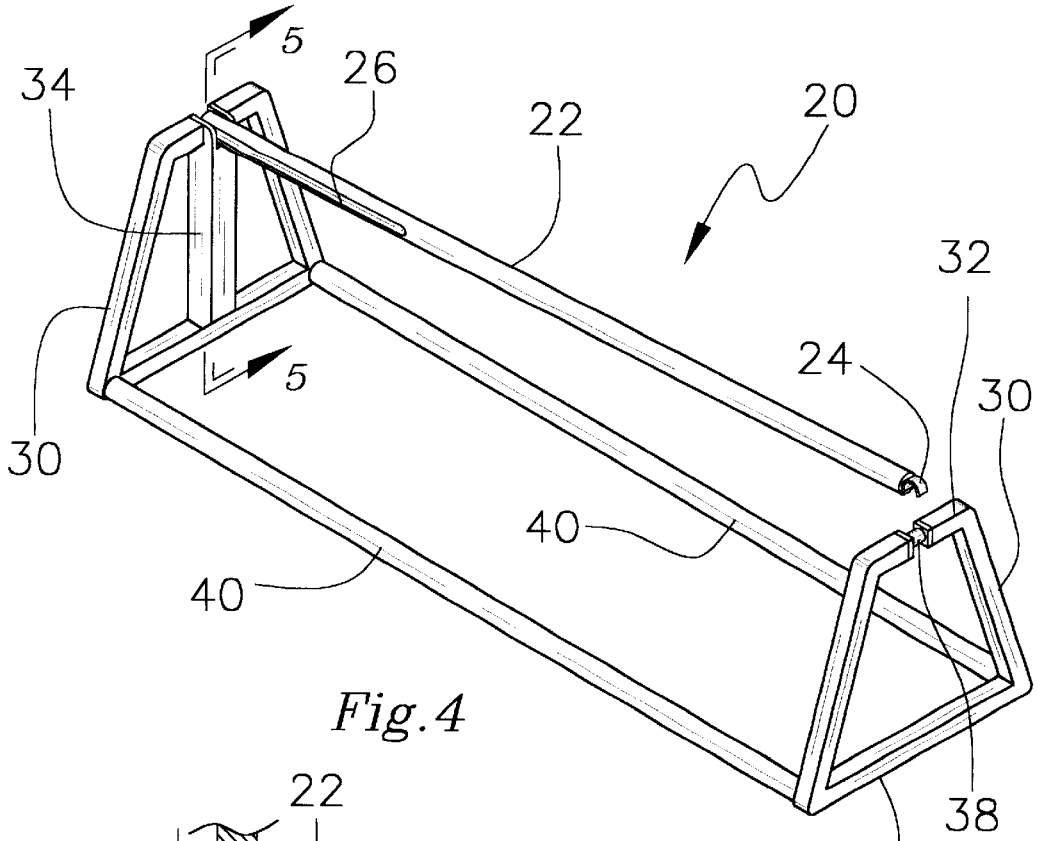
FIG. 4 is a schematic perspective view of the frame member of the present invention.
Figure 5:
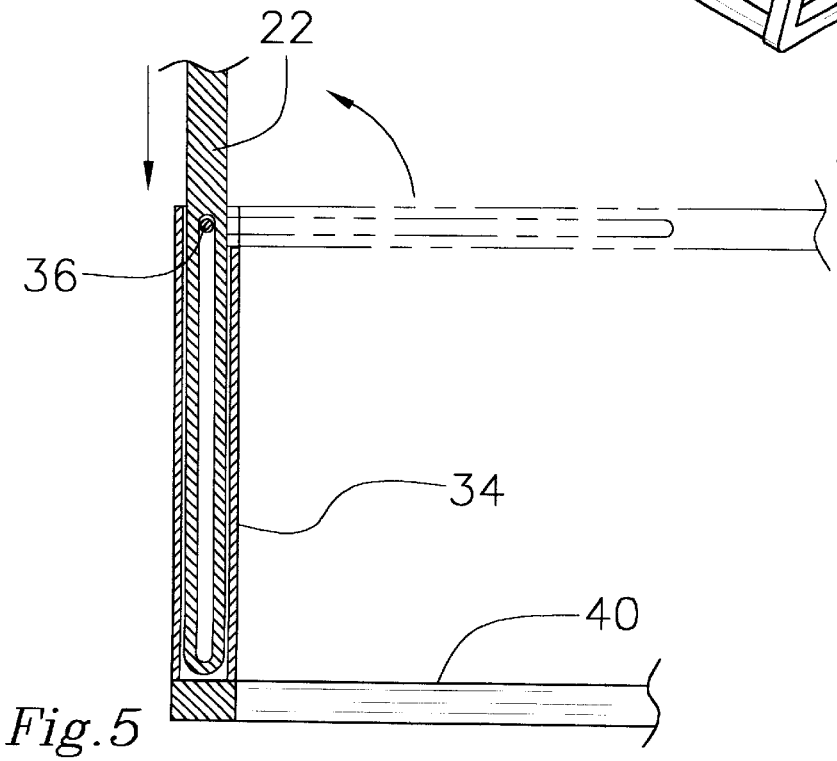
FIG. 5 is a schematic detail view of the present invention taken along line 5—5 of FIG. 4.

With reference now to the drawings, and in particular to FIGS. 1 through 5 thereof, a new bag assembly embodying the principles and concepts of the present invention and generally designated by the reference numeral 10 will be described.

As best illustrated in FIGS. 1 through 5, the bag assembly 10 generally comprises a frame assembly 20, a cover member 50, and a pair of strap members 60.

The frame assembly 20 includes a pair of generally trapezoidal end portions 30. The frame assembly 20 includes a centrally positioned upper frame member 22 which has a proximal end pivotally coupled to an upper cross member 32 of a first one of the end portions 30. The upper frame member 22 extends between the end portions 30 such that a hook portion 24 positioned at a distal end of the upper frame member 22 is selectively engageable to an upper cross member 32 of a second one of the end portions 30.

The upper cross member 32 of the second one of the end portions includes a neck portion 38 for receiving the hook portion 24 of the upper frame member 22.

The first one of the end portions 30 includes a sleeve portion 34 which extends between the upper cross member 32 and a lower cross member 33 of the first one of the end portions 30. The sleeve member 34 is aligned with the proximal end of the upper frame member 22. The sleeve member 34 includes an open upper end and a closed lower end.

The proximal end of the upper frame member 22 includes a longitudinal slot 26.

A pin member 36 extends across the open end of the sleeve member 34. The pin member 36 is inserted through the longitudinal slot 26 such that the pin member 36 is slidable in the longitudinal slot 26 such that the proximal end of the upper frame member 22 is insertable into the open end of the sleeve member 34 when the upper frame member 22 is pivoted into an upright position. Thus the sleeve member 34 holds the upper frame member 22 in the upright position when the proximal end of the upper frame member 22 is fully inserted into the sleeve member 34.

The frame assembly 20 includes a pair of lower frame members 40. Each of the lower frame members 40 extends in a spaced generally parallel relationship to each other between the end portions 30.

The cover member 50 envelops the frame assembly 20. The cover member 50 includes a base portion 52 for receiving a bottom of the frame assembly 20. Thus the bottom of the frame assembly 20 holds the base portion 52 in a generally planar position.

The cover member 50 includes a slit 54 extending between medial portions of opposite ends of the base portion 52 to form a pair of upper side portions 53. Opposite sides of the slit 54 are couplable to each other for closing the cover member 50 around the frame assembly 20.

Each of the strap members 60 includes opposite ends coupled to an associated one of the upper side portions 53 to form a pair of loops for facilitating carrying of the bag assembly 10.

The cover member 50 includes a plurality of exterior pockets 56 positioned on an exterior surface of the cover member 50 for permitting access to each of the exterior pockets 56 when the cover member 50 is closed.

The cover member 50 includes a plurality of flap portions 58. Each of the flap portions 58 is positioned adjacent to an opening of an associated one of the exterior pockets 56 thus each flap portion 58 is positioned for covering the opening of the associated exterior pocket 56.

A first portion of hook and loop fastener is coupled to each of the flap portions 58. A second portion of a hook and loop fastener is coupled to an exterior surface of each of the exterior pockets 56. The second portion of hook and loop fastener is complimentary to the first portion of hook and loop fastener thus each flap portion 58 is engageable to the exterior surface of the associated exterior pocket 56 for holding the flap portion 58 over the opening of the associated exterior pocket 56. Thus each the flap portion 58 is designed for preventing an object positioned in the associated exterior pocket 56 from passing through the opening of the associated exterior pocket 56 when the first portion of hook and loop fastener is engaged to the second portion of the hook and loop fastener.

In use, the user would open the cover member and extend the upper cross member into an upright position. As an illustrative example if the sporting goods to be transported were for hockey the following order would be used. The user would first place their gloves on the upper cross member, followed in order by: helmet, jersey, elbow pads, shoulder pads, skates, pants, socks, knee pad, and athletic support if appropriate. The user would then return the upper cross member to the horizontal position and place the hook portion over the neck portion of the end portion. The sporting goods can then be transported to or from the sporting area and are ready to be removed and put on by the user in the proper order.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A bag assembly comprising:

a frame assembly having a pair of end portions, said frame assembly including an upper frame member having a proximal end pivotally coupled to an upper cross member of a first one of said end portions, said upper frame member extending between said end portions such that a distal end of said upper frame member is selectively engageable to an upper cross member of a second one of said end portions;

a cover member for enveloping said frame assembly;

a strap member having opposite ends coupled to said cover member for facilitating transporting of said bag assembly; and said first one of said end portions having a sleeve portion extending between said upper cross member and a lower cross member of said first one of said end portions, said sleeve member being aligned with said proximal end of said upper frame member, said sleeve member having an open upper end and a closed lower end.

2. The bag assembly of claim 1, further comprising:

a hook portion positioned at said distal end of said upper frame member such that the said upper frame member is selectively engageable to said upper cross member of said second one of said end portions.

3. The bag assembly of claim 1, further comprising:

said proximal end of said upper frame member having a longitudinal slot;

a pin member extending across said open end of said sleeve member, said pin member being inserted through said longitudinal slot such that said proximal end of said upper frame member is insertable into said open end of said sleeve member when said upper frame member is pivoted into an upright position when said proximal end of said upper frame member is fully inserted into said sleeve member.

4. The bag assembly of claim 1, further comprising:

said frame assembly including a pair of lower frame members, each of said lower frame members extending in a spaced generally parallel relationship to each other between said end portions.

5. The bag assembly of claim 1, further comprising:

said cover member having a base portion for receiving a bottom of said frame assembly whereby said bottom of said frame assembly holds said base portion in a generally planar position.

6. The bag assembly of claim 1, further comprising:

said cover member having a base portion for receiving a bottom of said frame assembly whereby said bottom of said frame assembly holds said base portion in a generally planar position; and said cover member including a slit extending between medial portions of opposite ends of said base portion to form a pair of upper side portions, opposite sides of said slit being couplable to each other for closing said cover member around said frame assembly.

7. The bag assembly of claim 1, further comprising:

said frame assembly including a pair of lower frame members, each of said lower frame members extending in a spaced generally parallel relationship to each other between said end portions.

8. The bag assembly of claim 1, further comprising:

a hook portion positioned at said distal end of said upper frame member such that the said upper frame member is selectively engageable to an upper cross member of said second one of said end portions;

said upper cross member of said second one of said end portions having a neck portion for receiving said hook portion of said upper frame member;

said first one of said end portions having a sleeve portion extending between said upper cross member and a lower cross member of said first one of said end portions, said sleeve member being aligned with said proximal end of said upper frame member, said sleeve member having an open upper end and a closed lower end.

9. The bag assembly of claim 1, further comprising:

said cover member including a plurality of exterior pockets positioned on an exterior surface of said cover member for permitting access to each of said exterior pockets when said cover member is closed.

10. The bag assembly of claim 9, further comprising:

said cover member including a plurality of flap portions, each of said flap portions being positioned adjacent to an opening of an associated on of said exterior pockets whereby each flap portion is positioned for covering said opening of said associated exterior pocket;

a first portion of hook and loop fastener being coupled to each of said flap portions; and a second portion of a hook and loop fastener being coupled to an exterior surface of each of said exterior pockets, said second portion of hook and loop fastener being complementary to said first portion of hook and loop fastener whereby each flap portion is engageable to said exterior surface of said associated exterior pocket for holding said flap portion over said opening of said associated exterior pocket whereby each said flap portion is adapted for preventing an object positioned in an associated exterior pocket from passing through said opening of said associated exterior pocket when the first portion of hook and loop fastener is engaged to said second portion of said hook and loop fastener.

11. A bag assembly comprising:

a frame assembly having a pair of end portions, said frame assembly including an upper frame member having a proximal end pivotally coupled to an upper cross member of a first one of said end portions, said upper frame member extending between said end portions such that a distal end of said upper frame member is selectively engageable to an upper cross member of a second one of said end portions;

a cover member for enveloping said frame assembly;

a strap member having opposite ends coupled to said cover member for facilitating transporting of said bag assembly;

a hook portion positioned at said distal end of said upper frame member such that the said upper frame member is selectively engageable to said upper cross member of said second one of said end portions; and said upper cross member of said second one of said end portions having a neck portion for receiving said hook portion of said upper frame member.

12. A bag assembly comprising:

a frame assembly having a pair of end portions, said frame assembly including an upper frame member having a proximal end pivotally coupled to an upper cross member of a first one of said end portions, said upper frame member extending between said end portions such that a distal end of said upper frame member is selectively engageable to an upper cross member of a second one of said end portions;

a cover member for enveloping said frame assembly;

a strap member having opposite ends coupled to said cover member for facilitating transporting of said bag assembly;

said cover member having a base portion for receiving a bottom of said frame assembly whereby said bottom of said frame assembly holds said base portion in a generally planar position; and said cover member including a slit extending between medial portions of opposite ends of said base portion to form a pair of upper side portions, opposite sides of said slit being couplable to each other for closing said cover member around said frame assembly.

13. The bag assembly of claim 12, further comprising:

a pair of strap members, each of said strap members having opposite ends coupled to an associated one of said upper side portions to form a pair of loops for facilitating carrying of said bag assembly.

14. A bag assembly comprising:

a frame assembly having a pair of generally trapezoidal end portions, said frame assembly including a centrally positioned upper frame member having a proximal end pivotally coupled to an upper cross member of a first one of said end portions, said upper frame member extending between said end portions such that a hook portion positioned at a distal end of said upper frame member is selectively engageable to an upper cross member of a second one of said end portions;

said upper cross member of said second one of said end portions having a neck portion for receiving said hook portion of said upper frame member;

said first one of said end portions having a sleeve portion extending between said upper cross member and a lower cross member of said first one of said end portions, said sleeve member being aligned with said proximal end of said upper frame member, said sleeve member having an open upper end and a closed lower end;

said proximal end of said upper frame member having a longitudinal slot;

a pin member extending across said open end of said sleeve member, said pin member being inserted through said longitudinal slot such that said pin member is slidable in said longitudinal slot such that said proximal end of said upper frame member is insertable into said open end of said sleeve member when said upper frame member is pivoted into an upright position whereby said sleeve member holds said upper frame member in said upright position when said proximal end of said upper frame member is fully inserted into said sleeve member;

said frame assembly including a pair of lower frame members, each of said lower frame members extending in spaced generally parallel relationship to each other between said end portions; and a cover member for enveloping said frame assembly.

15. The bag assembly of claim 14, further comprising:

said cover member having a base portion for receiving a bottom of said frame assembly whereby said bottom of said frame assembly holds said base portion in a generally planar position;

said cover member including a slit extending between medial portions of opposite ends of said base portion to form a pair of upper side portions, opposite sides of said slit being couplable to each other for closing said cover member around said frame assembly; and a pair of strap members, each of said strap members having opposite ends coupled to an associated one of said upper side portions to form a pair of loops for facilitating carrying of said bag assembly.

16. The bag assembly of claim 14, further comprising:

said cover member including a plurality of exterior pockets positioned on an exterior surface of said cover member for permitting access to each of said exterior pockets when said cover member is closed.

17. The bag assembly of claim 16, further comprising:

said cover member including a plurality of flap portions, each of said flap portions being positioned adjacent to an opening of an associated on of said exterior pockets whereby each flap portion is positioned for covering said opening of said associated exterior pocket;

a first portion of hook and loop fastener being coupled to each of said flap portions; and a second portion of a hook and loop fastener being coupled to an exterior surface of each of said exterior pockets, said second portion of hook and loop fastener being complementary to said first portion of hook and loop fastener whereby each flap portion is engageable to said exterior surface of said associated exterior pocket for holding said flap portion over said opening of said associated exterior pocket whereby each said flap portion is adapted for preventing an object positioned in an associated exterior pocket from passing through said opening of said associated exterior pocket when the first portion of hook and loop fastener is engaged to said second portion of said hook and loop fastener.

18. The bag assembly of claim 14, further comprising:

said cover member having a base portion for receiving a bottom of said frame assembly whereby said bottom of said frame assembly holds said base portion in a generally planar position;

said cover member including a slit extending between medial portions of opposite ends of said base portion to form a pair of upper side portions, opposite sides of said slit being couplable to each other for closing said cover member around said frame assembly;

a pair of strap members, each of said strap members having opposite ends coupled to an associated one of said upper side portions to form a pair of loops for facilitating carrying of said bag assembly;

said cover member including a plurality of exterior pockets positioned on an exterior surface of said cover member for permitting access to each of said exterior pockets when said cover member is closed;

said cover member including a plurality of flap portions, each of said flap portions being positioned adjacent to an opening of an associated one of said exterior pockets whereby each flap portion is positioned for covering said opening of said associated exterior pocket;

a first portion of hook and loop fastener being coupled to each of said flap portions; and a second portion of a hook and loop fastener being coupled to an exterior surface of each of said exterior pockets, said second portion of hook and loop fastener being complimentary to said first portion of hook and loop fastener whereby each flap portion is engageable to said exterior surface of said associated exterior pocket for holding said flap portion over said opening of said associated exterior pocket whereby each said flap portion is adapted for preventing an object positioned in said associated exterior pocket from passing through said opening of said associated exterior pocket when said first portion of hook and loop fastener is engaged to said second portion of said hook and loop fastener.

* * * * *